US012716303B2

(12) United States Patent
Bizama Almendras et al.

(10) Patent No.: US 12,716,303 B2
(45) Date of Patent: Aug. 25, 2026

(54) DRILLING TOOL CHANGER DEVICE AND A METHOD FOR MAKING THE CHANGE

(71) Applicants: Raúl Patricio Bizama Almendras, Lo Barnechea (CL); Felipe Izquierdo González, Lo Barnechea (CL)

(72) Inventors: Raúl Patricio Bizama Almendras, Lo Barnechea (CL); Felipe Izquierdo González, Lo Barnechea (CL)

( * ) Notice: Subject to any disclaimer, the term of this patent is extended or adjusted under 35 U.S.C. 154(b) by 0 days.

(21) Appl. No.: 19/395,757

(22) Filed: Nov. 20, 2025

(65) Prior Publication Data

US 2026/0071506 A1 Mar. 12, 2026

Related U.S. Application Data

(60) Division of application No. 19/016,834, filed on Jan. 10, 2025, now Pat. No. 12,497,846, which is a continuation-in-part of application No. PCT/IB2022/056473, filed on Jul. 13, 2022.

(51) Int. Cl.
*E21B 19/18* (2006.01)
*E21B 19/20* (2006.01)

(52) U.S. Cl.
CPC ..... *E21B 19/18* (2013.01); *E21B 19/20* (2013.01)

(58) Field of Classification Search
None
See application file for complete search history.

(56) References Cited

U.S. PATENT DOCUMENTS 4,974,686 A * 12/1990 Hisey ..... E21B 19/20 173/164
2015/0315859 A1* 11/2015 Strydom ..... E21B 17/1085 166/85.5
2017/0234087 A1* 8/2017 Gaska ..... E21B 19/18 175/85
2023/0038886 A1* 2/2023 Bender ..... E21B 19/18
2024/0218752 A1* 7/2024 Fosler ..... E21B 19/20

FOREIGN PATENT DOCUMENTS

WO WO-2019226096 A1 * 11/2019 ..... E21B 19/146

* cited by examiner

*Primary Examiner* — Kipp C Wallace
(74) *Attorney, Agent, or Firm* — Olson & Cepuritis, Ltd.

(57) ABSTRACT

A device and a method for changing the drill bits, tricone bits or DTH bits of drill strings on a drilling platform is describe herein, the device comprising an arm element (1) moveable in a rotating, vertical or horizontal manner. A post or supporting element (5) is connected to one of the ends of arm (1) and it is connected to arm (1) in such a way that it moves the arm. Element (5) serves as a base for arm element (1) and includes a drive unit (6)) allowing arm (1) to retract and extend in a controlled manner. A drill bit storage and receiving element (3) is at the other end of the arm (1), and element (3) has a rotating surface, in addition to having a hydraulic motor (7) or other type of motor to move same.

4 Claims, 5 Drawing Sheets

DRILLING TOOL CHANGER DEVICE AND A METHOD FOR MAKING THE CHANGE

CROSS-REFERENCE TO RELATED APPLICATIONS

This application is a divisional of U.S. application Ser. No. 19/016,834, filed on 10 Jan. 2025, which is a continuation-in-part of PCT/IB2022/056473, filed on 13 Jul. 2022, each of which is incorporated herein by reference in its entirety.

FIELD OF THE INVENTION

The present invention relates to a device for changing drilling tools (bit, tricone or DTH) in a drilling string and a method associated with changing the bits, tricone or DTH.

BACKGROUND OF THE INVENTION

Mobile drilling units (or drilling rigs) are used for drilling blast holes in large-scale mining, large-scale quarrying and large-scale prospecting operations. Surface units have a pivoting mast mounted on a drilling platform. A drill string is mounted inside or in front of the mast and rotated to drill into the ground. The drill string consists of, depending on the technique used, a drilling tool (bits, tricone or DTH), a series of bars and some intermediate devices. The drill bit is mounted on the lower working end of the drill string. The bars connect the drilling tool to a rotation source mounted on the mast. The drill injects a liquid or gaseous fluid to extract the debris produced by drilling. This fluid and torque are transmitted through the rods to the drill bit, tricone or DTH tool to enable the drilling operation. As the drilling operation progresses, more rods are added to the drill string.

Before drilling can begin, the drilling tool will need to be attached to the string. This process involves manually positioning the drilling tool under a rod to allow engagement. Upon completion of a drilling operation, it will be necessary to disengage the drilling tool. drilling the bar and removing it from the string. While many of the operations in the drilling process can be performed autonomously, coupling/uncoupling of drilling tools still requires manual intervention from operators. This represents a significant danger for operators and has the potential to cause serious injuries as a result of any lack of control that occurs in the devices and tools used that contain a large amount of energy and there is permanent exposure of operators to these elements.

In the state of the art, some equipment and devices are known that allow mechanical or semi-autonomous change of the drill bit or tricone devices of the drill strings. For example, international patent application W02019371150A1 is known where a drill bit replacement apparatus is disclosed for replacing a drill bit in a drilling tool, the apparatus comprises: a drill chuck comprising one or more drill bit receptacles, each drill bit receptacle adapted to receive at least one drill bit; and positioning means adapted to move the bit holder between at least one storage position and one or more replacement positions, wherein each replacement position aligns at least one socket of the bit with the drilling tool.

As the drill bit is driven into the ground, the mechanical force imparted on the drill bit eventually wears and dulls the drill bit. Under certain circumstances, the drill bit can fracture and break. Worn or fractured bits need to be replaced. To complete this, the drilling operation must be stopped, and the drilling tool must be recovered to the surface to allow for bit replacement. The drill bit is normally threadedly connected to the lower end of the drilling tool. The threaded connection is oriented so that this rotational force does not loosen the threaded connection, but rather acts to tighten the connection. To change the bit, a starter mechanism is used to "break" the torque between the bit bar drilling and drill bit, loosening the tension on the threaded joint. Once the tension has been released, an operator typically removes the bit and places it away from the drilling tool. A replacement drill bit is then physically placed under the drilling tool to secure the drill bit to the drilling tool. The document indicates that this problem in the art is known, that is, there is a significant danger to operators and injuries may occur as a result of uncontrolled movement of drilling tools during the changing process. Risks increase with large diameter drilling operations, where the increased size and weight of the bits make them much more difficult to maneuver.

While many parts of drilling operations can be completed autonomously or semi-autonomously, changing bits still requires at least some manual intervention from an operator, usually at the machine. If a drilling rig is operated autonomously, then the drilling rig must be switched to manual operation whenever drill bits need to be replaced. Due to the need for manual intervention, the safety, capital, operating cost or production advantages offered by the autonomous drilling rig are reduced during bit changes. This is particularly problematic in hard rock drilling operations where multiple bit changes may be required during each drilling shift.

Here at this point it is also important to indicate that the cost of lost profits from having the equipment without drilling is very high, both due to the value of the equipment and all the assistance it requires and because of what is no longer produced, so it is of great importance. interest in finding ways to replace the drill bits that are automated, first to avoid the danger of exposure of the equipment operators and that, in addition, dramatically reduce the replacement time so that the equipment can return to drilling work and be lost. the shortest possible time in the downtime of said equipment. In the above application, the bit replacement apparatus is adapted to place a bit holder under a drilling tool. In this way, a drill bit located in the drill bit socket can be positioned below the drilling tool to allow engagement of the drill bit to the drilling tool. Alternatively, an empty bit socket may be placed under the drilling tool to allow disengagement of the bit from the drilling tool. Each bit socket holds a single bit. Alternatively, a single bit socket can accommodate two or more bits. In such an arrangement, it is envisaged that locating means or dividers may be used to separate the bits in the bit socket.

Another solution to this problem is raised in the U.S. Pat. No. 11,261,677, which discloses a drilling platform that includes a plurality of interchangeable drilling tubes, where the drilling bits are arranged in an end section of a drill pipe end. The drill bit being attached to the end section by means of a threaded connection and torque being provided to the drill bit by means of a spline coupling. The drilling rig comprises a bottom support device and a depressor device. The system includes a bit storage device arranged to contain a plurality of bits, a clamping arm for selective gripping of a bit. The gripping arm may further comprise a motion sensor, arranged to control the movement of the gripping arm, and the system may further comprise a control unit. The control unit being arranged to receive information from the sensors and the drilling equipment, and to control the movement of the gripping arm, the gripping means, the drill bit storage device and the detightening device of the drilling equipment.

According to the first aspect, a bit changing system is provided for at least semi-automatic changing of bits in a drilling rig. The Drilling rig is configured for vertical or near-vertical drilling. The drilling rig may comprise a plurality of interchangeable drill pipes, where the drill bits are arranged in an end section of an end drill pipe. The drill bit may be attached to the end section by means of a threaded connection and torque may be provided to the drill bit by means of a slot coupling. The drilling equipment may further comprise a bottom support device and a detightening device configured to loosen the threaded connections of the drill pipes. The system may comprise a bit storage device, arranged adjacent and parallel to a drilling center of the drilling rig and arranged to contain a plurality of bits. The drill bit storage device may further be arranged to move drill bits between storage positions and an exchange position comprised therein. The storage positions may be arranged to store bits and the exchange position may be arranged to move bits to and from the bit storage device.

The system may further comprise a gripping arm comprising gripping means configured for selective gripping of a drill bit. The gripper arm may be arranged to move the gripper means between the exchange position and a drilling center of the drilling platform. The gripping arm may further comprise a motion sensor, arranged to monitor movement of the gripping arm. The system may further comprise a control unit, arranged to receive information from the sensors and the drilling platform, and to control the movement of the clamping arm, the clamping means, the bit storage device and the breaking device rig.

However, as previously shown in the State of the Art, there is a clear need to provide replacement equipment or devices and associated methods to change the drill bits directly in the drilling strings through automatic operations where exposure is avoided. of human operators to this dangerous operation and the downtime of the equipment is reduced. Additionally, there is no equipment available for large-scale mining that can simultaneously handle and release the guide bushing from the drill string, which is a crucial stage for accessing the drill bit and allowing its replacement in a safe and more effective manner.

In addition, there is a need to provide a universal device that works on the drill string and that can be used in the equipment of different manufacturers of mining drills and that can even be used in equipment that is not designed from the factory to carry out the replacement of the drilling bits or what is known as an equipment retrofit.

SUMMARY OF THE INVENTION

In a first aspect, the present invention relates to device for changing the drill bits, tricones or DTH of the drilling strings in surface and production drilling rigs in large-scale mining and for handling and/or changing the guide bushings of said string on the drilling platform characterized in that said equipment comprises:

(a) an arm element (1) that is capable of moving rotatably, vertically or horizontally;

(b) a post or support element (5) that is connected to one of the ends of said arm element (1) and that is connected to said arm element (1) so that it serves as a displacement for said element; additionally, this post or support element (5) that serves as a base for the arm element (1) includes a drive unit (6) that allows the arm (1) to retract and extend in a controlled manner; said post or support element (5) is fixed to the main structure of the machine and at the same time fixes said arm element solidly to the surface drilling machine in addition to providing access to all the power and signal connections of the equipment;

(c) a drill bit storage and reception element (3) that is located on the other side of said arm element (1); said drill bit storage and reception element (3) has a revolver-type or other type rotating surface, also with a hydraulic motor (7) or another type to provide movement;

(d) a clamp arm or vertical displacement guide (4) which may be on said bit storage and receiving element (3) and which is also integral with said element (3), and which may be on the sides of said bit receiving element (3) and even located in front of the drilling string, which in turn is capable of housing a clamp element (2) that moves up and down said clamp arm (4); said clamp element (2) is capable of handling the guide bushing, with vertical movement which allows the height clearance of the machine component allowing access to the breaking key and thus releasing the drilling tool (drill bit, Tricone or DTH) from the drilling string and the consequent provision of the bit for replacement; said storage element also contains the support parts necessary for the task of breaking torque of the threaded end of the drill bits, tricone bits or DTH bits of the drilling strings in surface and large mining production drills, which allows the torsional and vertical forces to be dissipated through the general structure of the machine;

(e) a PLC control panel capable of managing and controlling said arm element (1), said post element (5), said hydraulic or electric motor element or of another type (7) and said bit storage and reception element (3), and said clamp arm (4) to change the drill bits, tricone bits or DTH bits of the drilling strings in surface and mining production drills and the guide bushings of said string on the drilling platform; and (f) a remote control element installed in the cabin with which the operator controls the device from the cabin coordinating the sequence with the functions and movements of the drill.

In some embodiments, said drill bit reservoir or rack element (3) is capable of storing new and used drill bits; and/or drive unit (6) and the hydraulic, electric motor unit (7) are capable of moving said arm units (1), the bit storage and receiving element (3) and the clamp arm (4) with the clamp element (2) from passive or first positions to active or second positions; and/or the device is a universal type device that works on the drilling platform and that can be used in the equipment of different manufacturers of mining drills and can even be used in equipment that is not designed from the factory to replace drill bits or what is known as a retrofit of the equipment.

A second aspect of the present invention is a method for changing a drill bit, tricones or DTH of a drilling rig using the equipment of the first aspect comprising the steps of:

(a) performing a movement of said arm units (1), the bit storage and reception element (3) and the vertical displacement guide or clamp arm (4) with the clamp element (2) from a first rest position to a second working position on the drilling rod; on said drilling platform, the drill bit and string are already in an elevated position so that the drilling element storage and reception of drill bits (3) can be exactly below said drilling string and drill bit to be changed;

(b) on the drilling platform said clamp element (2) takes the guide bushing of the drilling string and makes it ascend along said string so that the drill bit element to be changed is visible, then said string and drill bit descend to remain in an empty unit of the drill bit storage and reception element (3);

(c) with said unit already occupied with the drill bit storage and reception element (3), with the drilling torque breaking tool the tightening of the drill bit to be changed is released; the string rotates and unscrews from the bit to be changed; the string then rises above the bit storage and reception element (3);

(d) the drill bit storage and receiving element (3) is moved by means of the drive unit (6) and the hydraulic, electric motor unit (7) or another type until a new drill bit element is found that will be connected to the drill string; and (e) the drilling string is then lowered to connect and screw it to the new drill bit and then said clamp element (2) which has the drilling string guide bushing is lowered to place said bushing in the drilling string and leave the unit ready for a new drilling cycle.

A third aspect of the present invention is a device for changing the drill bits, tricone bits or DTH bits of the drill strings in surface and production drilling machines in large-scale mining and for handling and/or changing the guide bushings of said string on the drilling platform, characterized in that said equipment comprises:

(a) an arm element (1) that is capable of rotating, vertical, frontal and/or retractable movement;

(b) a post or support element (5) that is connected to one of the ends of said arm element (1) and that is connected to said arm element (1) in such a way that it serves as a displacement for said element; additionally, this post or support element (5) that serves as a base for the arm element (1) includes a hydraulic or electric motor system element or another (6) that allows the arm (1) to move in a controlled manner;

(c) a bit storage and reception element (3) that is located on the other side of said arm element (1); said bit storage and receiving element (3) has a revolver-type or other rotating surface, also with a hydraulic, electric (7) or other type of motor to supply the movement;

(d) a support structure (8) with a drive system (9) that supports a clamp arm (4) which in turn is capable of housing a clamp element (2) that moves up and down said support structure (8); said clamp element (2) is capable of handling the guide bushing through said drive system (9), with rotary and/or vertical movement which allows the height clearance of the machine component allowing the access of the breaking key and thus releasing the drilling tool (drill bit, Tricone or DTH) from the drilling string and the consequent provision of the bit for replacement; said storage element also contains the support parts necessary for the task of breaking torque of the threaded end of the drill bits, tricones or DTH of the drilling strings in surface and large mining production drills, which allows the torsional and vertical forces to be dissipated through the general structure of the machine;

(e) a PLC control panel (10) capable of managing and controlling said arm element (1), said post or support element (5, 8), said hydraulic or electric motor element or of another type (6, 7, 9) and said bit storage and reception element (3), and said clamp arm (4) to change the drill bits, tricones or DTH of the drilling strings in surface and mining production drills and the guide bushings of said string on the drilling platform;

(f) a remote control element installed in the cabin with which the operator controls the device from the cabin coordinating the sequence with the functions and movements of the drill; and In some embodiments of the third aspect, the equipment for changing the drill bits, tricone bits or DTH bits of the drill string is characterized in that said reservoir element or bit rack (3) is capable of storing new and used bits; and/or said drive system units (6, 9) and the hydraulic or other motor unit (7) are capable of moving said arm units (1), the bit storage and receiving element (3) and the gripper arm (4) with the gripper element (2) from passive or first positions to active or second positions; and/or the device is a universal type device that works on the drilling platform that can be located on the sides or in front of the drilling platform and that can be used on equipment from different manufacturers of mining drills and can even be used on equipment that is not designed from the factory to change bits or what is known as a retrofit of the equipment.

A fourth aspect of the present invention is a method for changing a drill bit, tricone bits or DTH bits of a surface and mining production drilling equipment and for handling the guide bushings of said string on the drilling platform using the equipment of the third aspect comprising the steps of:

(a) moving said gripper arm units (4) from a first rest position to a second working position on the drilling rod; on said drilling platform the drill bit and the string are already in a raised position;

(b) on the drilling platform, said gripper element (2) takes the guide bushing of the drilling string and makes it ascend through said string so that the bit element to be changed is visible;

(c) subsequently, said bit storage and reception element (3) moves from a passive to an active position towards the drill string so that said bit storage and receiving element (3) can be exactly under said drill string and the bit to be changed; then said string and bit descend to be in an empty unit of the bit storage and receiving element (3);

(d) being in said unit already occupied, with the torque breaking tool of the drill rig the tightening of the bit to be changed is released; then the string is raised to be above said bit storage and receiving element (3);

(e) the bit storage and receiving element (3) is moved by means of the drive units (6, 7) until it finds a new bit element that is to be connected and screwed to the drill string;

(f) Once the drill string is connected with the new bit, the bit storage and receiving element (3) is removed from the string to an inactive position; and (g) then said clamp element (2) having the guide bushing of the drilling string descends to place said bushing in the drilling string and leave the unit ready for a new drilling cycle.

A fifth aspect of the present invention is a device to change the drill bits, tricone bits or DTH bits of the drilling strings in surface and production drilling machines in large mining and the guide bushings of said string on the drilling platform characterized in that said equipment comprises:

(a) an arm element (3) that is capable of rotating, vertical or horizontal, frontal and retractable movement;

(b) a bit storage and reception element (2) that is arranged at the end of said arm (3), this bit reception element (2) carries inside it in suitably arranged spaces new bits that will replace the used bits of the drilling string and empty spaces that will house the used bit that is removed from said string; the bit storage and receiving element (2) has a revolver-type rotating surface or may be of another type, also with motor elements to supply the rotating movement or a movement of another type; said bit storage and changing element (2) also contains the support parts, necessary for the task of breaking torque of the threaded end of the bits, tricone bits or DTH of the drilling strings in surface and mining production drills, which allows the torsional and vertical stresses to be dissipated through the general structure of the machine;

(c) a set of manipulation of the guide bushing of the drilling rig that is located immediately before said arm (3) and said bit receiving element (2); said set of manipulation of the guide bushing is composed of an extension arm (5) that is capable of moving in a rotating, vertical, horizontal, frontal or retractable manner; at the top of said extension arm (5) there is a clamp or fork element (1) that moves up and down in order to manipulate the guide bushing of the drilling platform, with vertical movement which allows the height clearance of the machine component allowing access to the break key and thus releasing the drilling tool (drill bit, Tricone or DTH) from the drilling string and the consequent provision of the bit for replacement;

(d) said bits storage and reception elements (2) with the arm element (3) and the said platform guide bushing manipulation assembly are arranged in a container (4) in its inactive or rest position;

(e) a PLC control panel capable of handling said arm element (3), said bit storage and reception element (2) to change the bits, tricone bits or DTH bits of the drilling strings in surface and mining production drills and, said extension arm (5) and said clamp or fork (1) for handling the guide bushings of said string on the drilling platform; and (f) a remote control element installed in the cabin with which the operator controls the device from the cabin coordinating the sequence with the functions and movements of the drill.

In some embodiments of the fifth aspect, the equipment to change the bits, tricone bits or DTH bits of the drilling string is characterized in that said reservoir element or bit rack (2) is capable of storing new and used bits; and/or the motor units are capable of moving said arm units (3, 5), the bit storage and receiving element (2) and the clamp element (1) from passive or first positions to active or second positions on the drilling platform; and/or the device is a universal type device that works under the drilling platform and can be located on the sides or in front of the drilling platform; it can also be used in equipment from different mining drilling rig manufacturers and can even be used in equipment that is not designed from the factory to change the bits or what is known as a retrofit of the equipment.

A sixth aspect of the present invention is a method for changing a drill bit, tricone bits or DTH bits of a surface and mining production drilling rig and for handling the guide bushings of said string on the drilling rig using the equipment of the fifth aspect, comprising the steps of:

(a) opening the container (4); subsequently performing a movement of said drilling rig guide bushing handling assembly which is composed of the extension arm (5) and the fork or clamp element (1), from a first rest position to a second working position on the drill rod, such that the fork element (1) comes into contact with the drill string guide bushing lifting said guide bushing and disengaging it from the drill bit assembly of the drill string;

(b) performing a movement of said arm unit (3) and the drill bit storage and receiving element (2) from a first rest position to a second working position on the drill rod; on said drilling rig the drill bit and the drill string are already in a raised position so that the drill bit storage and receiving element (2) can be exactly below said drill string and said drill bit to be changed;

(c) lower the drill bit and the drill string into the empty space of the drill bit storage and receiving element (2), and then release the clamping of the drill bit to be changed with the torque breaking tool of the drill;

(d) the drill bit to be changed remains in the drill bit storage and receiving element unit (2); the drilling string is raised and then said storage element is moved by means of the motor units until it finds a new drill bit element that is going to be connected to the drilling string; said drilling string is lowered to connect the new drill bit to be used on the drilling platform;

(e) lower said clamp or fork element (1) that has the drill string guide bushing in the height position to place said bushing in the drilling string; and (f) remove the arm assembly (3) and bit changing element (2) to its rest position inside the container element (4); then the extension arm assembly (5) and the clamp or fork element (1) are removed from the platform and taken to their rest position inside the container (4) which serves to store the entire assembly described above.

DETAILED DESCRIPTION OF THE INVENTION

More particularly, the present invention relates to a universal device or equipment used or device used in large-scale mining to change the drill bits, tricone bits or DTH bits of the drilling strings, which integrates a drill rack element, for example, revolver type or of another type, to an extendable arm that is mounted on a rotating base. The equipment is a universal device that works on the drilling string and can be used in the equipment of different manufacturers of mining drills and can even be used in equipment that is not designed from the factory to change the drill bits or what is known as equipment retrofit.

The device can perform all the tasks necessary to change the drilling bits without the physical intervention of people. The equipment is capable of releasing the drill bit, removing the used drill bit and taking it to another position to store it, taking a new drill bit from another predefined position and taking it to the position of the rod to screw it in and make it available for drilling in a very short time. The sequence of movements can be done step by step or automatically. In person in the command or control cabin or remotely. This entire device can be mounted on a platform which can be attached to the drill or another assistance vehicle.

Figure 1:
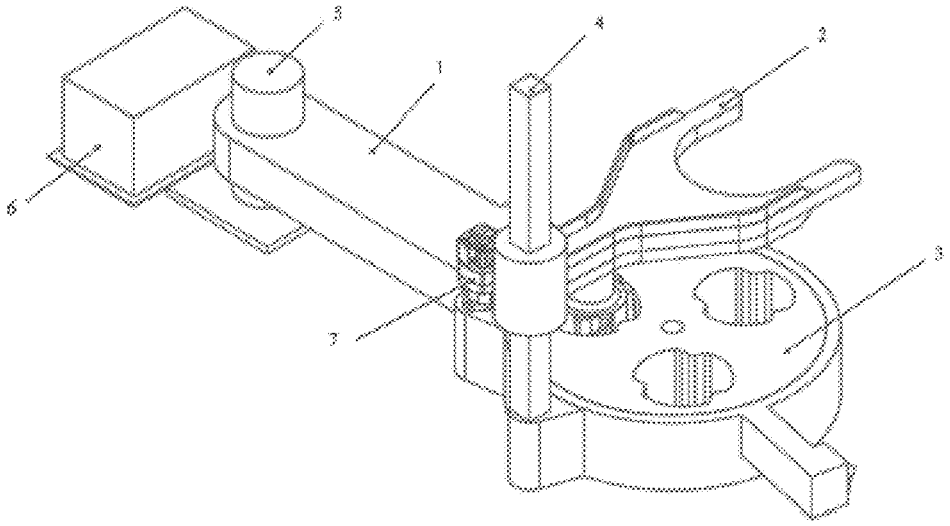
FIG. 1 presents the perspective view of the drilling tool changing equipment of the present invention.
Figure 2:
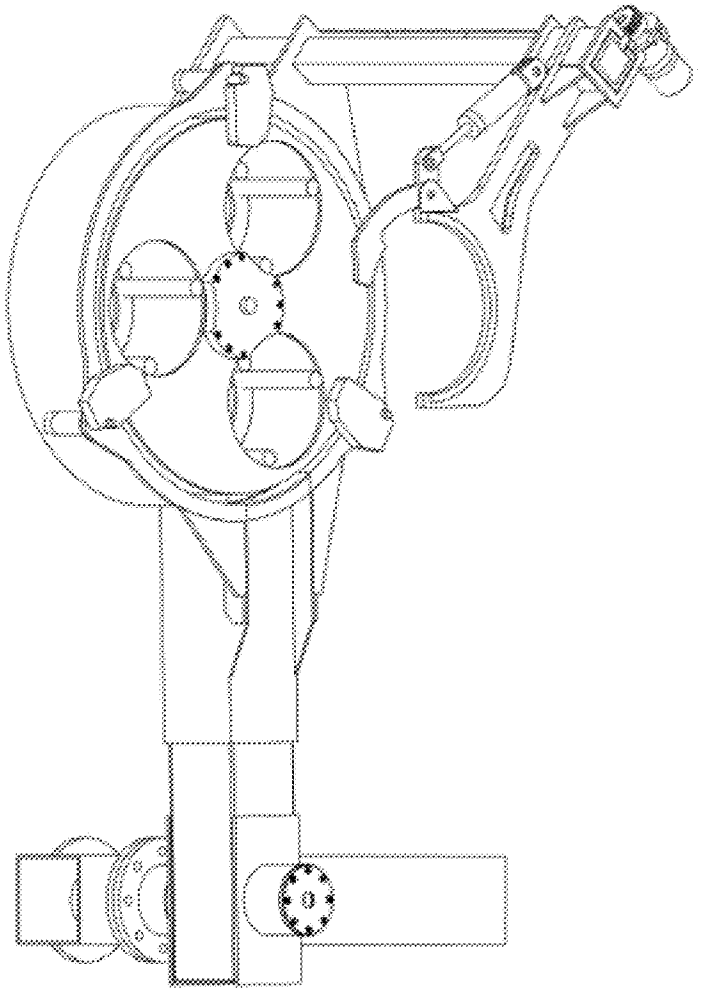
FIG. 2 presents a perspective view of the assembly, arm, revolver as a representative unit of the tool changing equipment.
Figure 3:
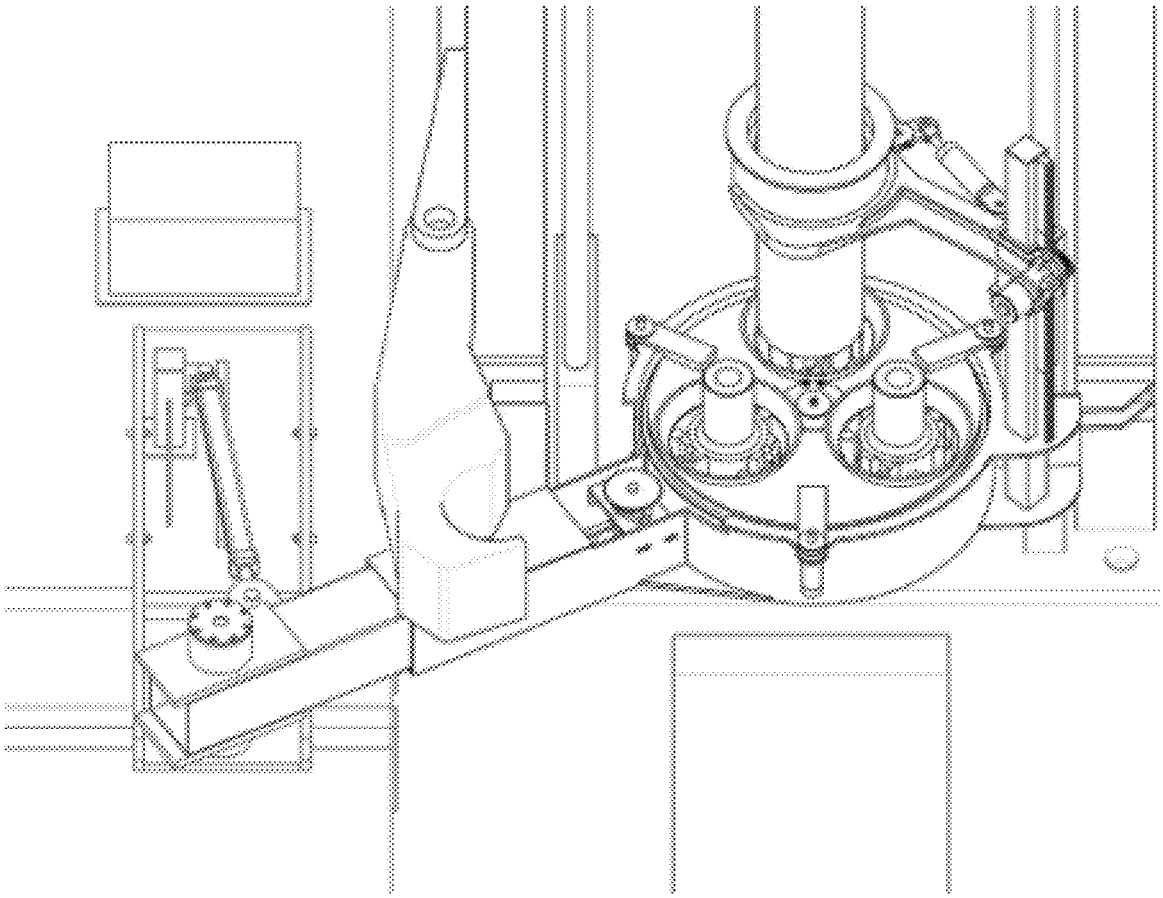
FIG. 3 presents a perspective view detailing the procedure for changing the drill bit using the head and clamping jaws of the present invention.

Going into detail now about the construction configuration of the equipment of the present invention and taking into account FIG. 1 to FIG. 3 presented, it is necessary to provide equipment for replacing drilling tools. A device for changing the drill bits, tricone bits or DTH bits of the drilling strings on the drilling platform, characterized in that said equipment comprises an arm element (1) that is capable of rotating, vertically or horizontally. A post or support element (5) that is connected to one of the ends of said arm element (1) and that is connected to said arm element (1) in such a way that it serves to move said element; Additionally, this post or support element (5) that serves as a base for the arm element (1) includes a drive unit (6) that allows the arm (1) to retract and extend in a controlled manner.

The equipment of the present invention also has a drill bit storage and reception element (3) that is located on the other side of said arm element (1), this element carries in its interior, in suitably arranged spaces, new drill bits that will replace the used drill bits of the drilling string and empty spaces that will house the used drill bit that is removed from said string. The drill bit storage and reception element (3) has a revolver-type rotating surface or maybe of another type, also with a hydraulic motor (7) or another type to supply it with the rotating movement or a movement of another type. This bit storage and receiving element (3) has a vertical displacement guide (4) on the periphery of one of its sides, which in turn is capable of housing a clamp element (2) that moves up and down said vertical displacement guide (4), in order to manipulate the guide bushing of the drilling platform and also, if necessary, to leave it ready to change the guide bushing.

The drive unit (6) and the hydraulic, electric motor unit (7) or of another type are capable of printing movement to said arm units (1), the bit storage and receiving element (3) and the vertical displacement guide (4) with the clamp element (2) from passive positions or from inactive or rest first positions to active positions or second positions in which the drill bit or guide bushing changes of the drilling string are made.

Another object of the present invention is to provide a method for changing a drill bit of a drilling rig which involves steps of execution on the drilling rig, see especially FIG. 3, where the drill string, the drill rod, the torque breaking arm of the drilling rig and the device that performs the change of the drill bit, tricone or DTH are shown. These steps initially begin with the realization of a movement of said arm units (1), the bit storage and reception element (3) and the vertical displacement guide (4) with the clamp element (2) from a first rest position to a second working position on the drilling rig; on said drilling rig the drill bit and the drilling rod are already in a raised position so that the bit storage and reception element (3) can be exactly under said drilling rig and the bit to be changed.

Subsequently, on the drilling platform, said clamp element (2) takes the guide bushing of the drilling string and makes it ascend along said string so that the drill bit element to be changed is visible, then said string and drill bit descend to remain in an empty unit of the drill bit storage and reception element (3). With said unit already occupied with the drill bit storage and reception element (3), with the torque breaking tool of the drilling string the tightening of the drill bit to be changed is released and it will rest in the empty compartment of the element (3).

Then the drill string is removed and the bit storage and receiving element (3) is moved by means of the drive unit (6) and the hydraulic, electric motor unit (7) or another type, until a new drill bit element that is going to be connected to the drill string where the drill string is first lowered and then said clamp element (2) that has the guide bushing of the drill string, descends to place said bushing in The drill string and drill string torque breaking tool tightens the bit into the string to ready the unit for a new drilling cycle. Finally, the equipment is removed by means of a movement that is produced by means of the drive unit (6) and the hydraulic, electric motor unit (7) or other such that the equipment goes from an active position on the drill rod to an inactive position off the platform.

Figure 4:
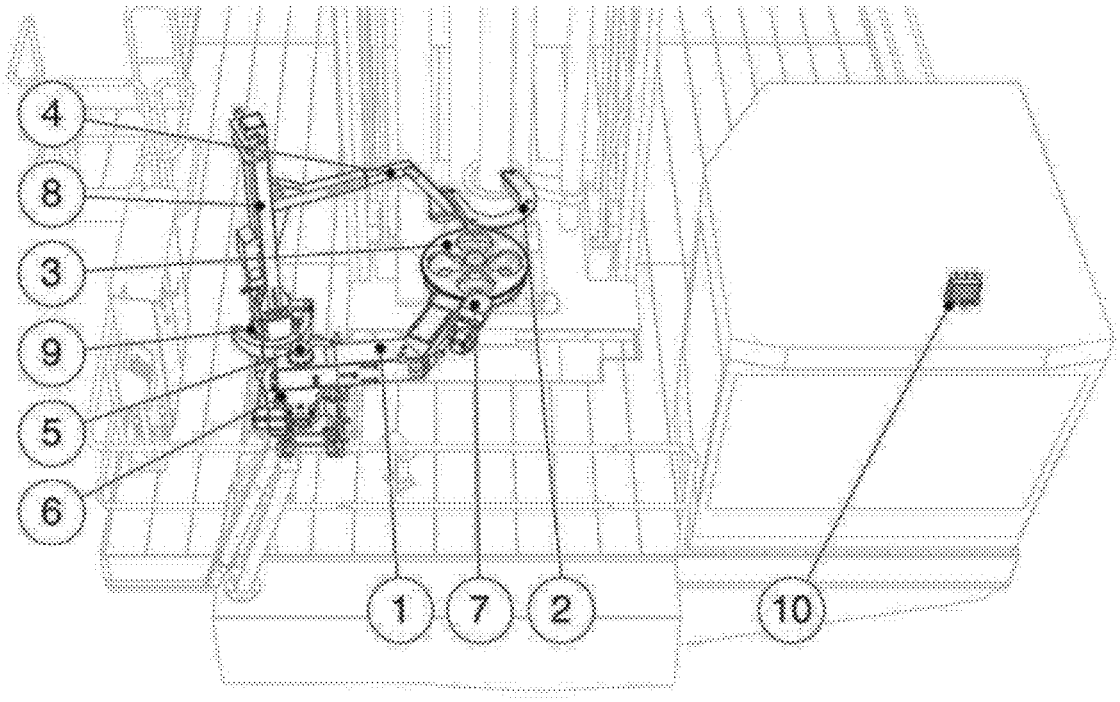
FIG. 4 presents a perspective view of another preferred embodiment of the drilling tool changing equipment of the present invention.

Going into detail now about the configuration of another preferred embodiment of the construction of the equipment of the present invention and taking into account FIG. 4 presented, a drilling tool replacement equipment is shown. A device for changing the drill bits, tricone bits or DTH bits of the drilling strings on the drilling platform that can be on each side or pointing towards the center of the drilling string characterized in that said equipment comprises an arm element (1) that is capable of rotating, vertically or horizontally. A post or support element (5) that is connected to one of the ends of said arm element (1) and that is connected to said arm element (1) so that it serves as a displacement for said element; additionally this post or support element (5) that serves as a base for the arm element (1) includes a hydraulic, electric or other motorization system element (6) that allows the arm (1) to retract and extend in a controlled manner.

The equipment of the present invention also has a bit storage and reception element (3) which is located on the other side of said arm element (1), this element carries inside it in suitably arranged spaces new bits that will replace the used bits of the drilling string and empty spaces that will house the used bit that is removed from said string. The bit storage and reception element (3) has a revolver-type rotating surface or it can be of another type, also with a hydraulic, electric motor (7) or another type to supply the rotating movement or a movement of another type. The equipment in this modality also has a support structure (8) that supports a clamp arm (4) that has a clamp arm drive system (9) that in turn is capable of manipulating a clamp element (2) that moves up and down said support structure (8), this in order to manipulate the guide bushing of the drilling platform and also if necessary leave it ready to change the guide bushing. The drive units (6, 9) and the hydraulic, electric (7) or other type of motor unit are capable of injecting movement into said arm units (1), the bit storage and receiving element (3) and the gripper arm (4) with the gripper element (2) from passive or first inactive or rest positions to active or second positions in which the drill bit or guide bushing changes of the drilling string are carried out.

Another object of the present invention is to provide a method for changing a drill bit of a drilling rig which involves steps of execution on the drilling platform, see especially FIG. 4, where the string, the drilling rod, the torque breaking arm of the drilling tower and the device that performs the change of the drill bit, tricone or DTH can be seen, which can be located on the sides or pointing to the center of the drilling string. These steps begin initially with the movement of said gripper arm units (1) from a first rest position to a second working position on the drill rod; then on the drilling platform said gripper element (2) takes the guide bushing of the drill string and makes it ascend said string so that the bit element to be changed is visible. Then the bit storage and receiving element (3) moves from a passive position to an active position towards the drill rod so that said bit storage and receiving element (3) can be exactly under said drill rod and the bit to be changed.

Then said string and bit descend to rest in an empty unit of the bit storage and receiving element (3). Once said unit of the bit storage and receiving element (3) is occupied, the torque breaking tool of the drill string releases the tightening of the bit to be changed, and it will rest in the empty compartment of the element (3). The drill string is then withdrawn and the bit storage and receiving element (3) is moved by means of the drive unit (6) and the hydraulic, electric (7) or other motor unit until a new bit element is found which is to be connected to the drill string. The string is connected and screwed to the new bit and then the bit storage and receiving element (3) is withdrawn from the string to an inactive position by means of the drive units (6, 7).

Then said clamp element (2) having the guide bushing of the drill string is lowered to place said bushing in the drill string and leave the drill string ready for a new drilling cycle. Finally, the arm element (4) and clamp (2) are withdrawn by means of a movement that is produced by means of the drive unit (9) in such a way that the equipment passes from an active position on the drilling rod to an inactive position outside the platform.

Figure 5:
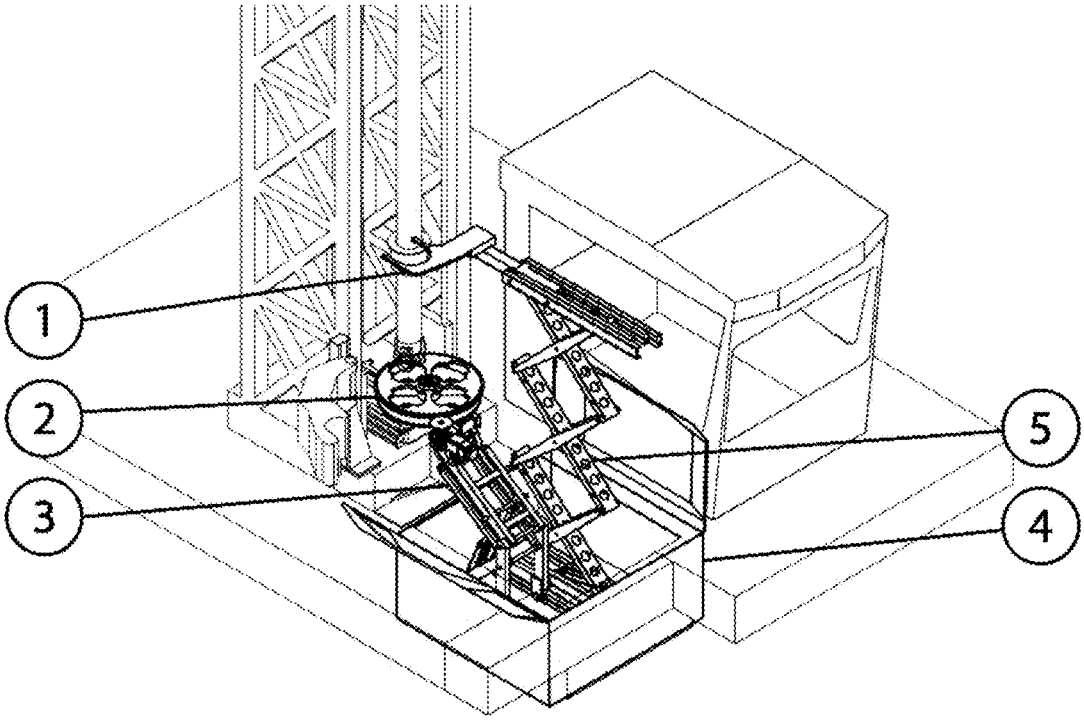
FIG. 5 presents a perspective view of another preferred embodiment of the drilling tool changing equipment of the present invention.

Going into detail of the configuration of another preferred embodiment of construction of the equipment of the present invention and taking into account FIG. 5 presented, it is necessary to provide equipment for replacing the drilling tools. A device for changing the drill bits, tricone bits or DTH bits of the drilling strings on the drilling platform characterized in that said equipment comprises an arm element (3) that is capable of moving in a rotating, vertical or horizontal, frontal or retractable manner. At the end of said arm there is a bit storage and reception element (2), this element carries inside it in suitably arranged spaces new bits that will replace the used bits of the drilling string and empty spaces that will house the used bit that is removed from said string. The bit storage and reception element (2) has a revolver-type rotating surface or it can be of another type, also with a motor to supply it with the rotating movement or a movement of another type. Before the arm (3) and bit storage and reception assembly (2) there is a set for handling the guide bushing of the drilling platform that consists of an extension arm (5) that is capable of rotating, vertical or horizontal movement; in the upper part of said extension arm (5) there is a clamp or fork element (1) that moves up and down in order to handle the guide bushing of the drilling platform.

The motors or transmission of the assembly are capable of printing movement to said arm units (3), the storage and reception element of the drill bits (2) and the manipulation assembly of the guide bushing of the drilling platform, which is composed of the extension arm (5) and the clamp or fork element (1) to move vertically or horizontally from passive positions or from inactive or resting first positions to active positions or second positions in which the changes of the drill bit or guide bushing of the drilling string are made. All of the above is contained in a container element (4) that stores the entire assembly described above; said container element (4) can be found at the level of the drilling platform or slope and/or hidden below the drilling surface of the platform in such a way that it makes its operation easier and simpler for the operators by maintaining an area clear of unwanted elements in the area of the drilling platform.

Another object of the present invention is to provide a method for the above preferred embodiment for the purpose of changing a drill bit of a drilling rig which involves steps of execution on the drilling rig, see especially FIG. 5, where the string, the drilling rod, the torque breaking arm of the drilling rig and the device that performs the change of the drill bit, tricone or DTH can be seen. These steps initially begin with the opening of the container (4); the execution of a movement of said assembly for handling the guide bushing of the drilling rig which is composed of the extension arm (5) and the clamp or fork element (1), from a first rest position to a second working position on the drilling rod, such that the fork element (1) comes into contact with the guide bushing of the drilling string lifting said guide bushing and disengaging it from the drill bit assembly of the string. The arm unit (3) and the bit storage and receiving element (2) then move from an inactive position inside the container (4) to an active position towards the drill rod; on said drilling platform the drill bit and the drill rod are already in a raised position so that the bit storage and receiving element (2) can be exactly under said drilling rod; then the rod and the bit descend to reach an empty space in the bit storage and receiving element (2) and then with the torque tool of the platform the bit to be changed is loosened from the drill rod.

Then the drill string is removed and the bit storage and receiving element (2) is moved by means of the equipment motors, until it finds a new bit element that is to be connected to the drill string where the drill string is first lowered by coupling it to the new bit element; subsequently the bit storage and receiving element (2) is removed by means of the drive units to a rest position outside the platform and going into the container (4); and then said clamp or fork element (1) having the guide bushing of the drilling string in the height position, descends to place said bushing in the drilling string, then the extension arm assembly (5) and the clamp or fork element (1) are removed from the platform and taken to their rest position inside the container (4) which serves as storage for the entire assembly described above.

Although the present invention has been described with the preferred embodiments shown, it is understood that the modifications and variations that preserve the spirit and scope of this invention are understood within the scope of the attached claims, the examples included are some embodiments of the invention, but they should not be interpreted as limiting the invention.

What is claimed is:

1. A device to change a used bit of a drilling string in a surface and production drilling machine in large mining and for handling a guide bushing of said string on a drilling platform wherein the device comprises:

(a) an arm element (3) that is capable of rotating in addition to vertical or horizontal movement;

(b) a bit storage and reception element (2) that is arranged at the end of said arm (3), said bit storage and reception element (2) carries inside it in suitably arranged spaces at least one new bit that will replace the used bit of the drilling string, said bit storage and reception element also having an empty space that will house the used bit that is removed from said drilling string; the bit storage and reception element (2) has a rotating surface and a motor to rotate the rotating surface; said bit storage and reception element (2) also contains parts necessary for supporting the used bit during a breaking of a threaded connection of the used bit of the drilling string, which allow torsional and vertical stresses to be dissipated through the drilling platform;

(c) a guide bushing manipulation assembly located immediately adjacent said arm (3); said guide bushing manipulation assembly is composed of an extension arm (5) that is capable of vertical movement relative to the drilling platform; a clamp or fork element (1) at the top of the extension arm that moves up and down in order to slide the guide bushing relative to the used bit of the drilling platform, with vertical movement which allows the height clearance of the machine component wherein sliding of the guide bushing relative to the used bit allows access to a break key for releasing the used bit from the drilling string and the consequent provision of one of the at least one new bits for replacement;

(d) said bit storage and reception element (2), the arm element (3), and guide bushing manipulation assembly are arranged in a container (4) in an inactive position and are extended from the container during use;

(e) a PLC (programmable logic controller) control panel configured to control said arm element (3) and said bit storage and reception element (2) to enable replacement of the used bit with one of the at least one new bits, the PLC control panel further configured to control sliding of the guide busing using said extension arm (5) and said clamp or fork element (1) for handling the guide bushings of said string on the drilling platform; and (f) a remote control element installed in a cabin with which an operator controls the device from the cabin coordinating the sequence with the functions and movements of the drill.

2. The equipment for changing the drill bits, tricone bits or DTH bits of the drilling string device of claim 1, characterized in that motor units are provided for moving said arm, said extension arm, the bit storage and receiving element (2), and the clamp or fork element (1) from the inactive position to an active position.

3. The equipment for changing the drill bits, tricone bits or DTH bits of the drilling string device of claim 1, characterized in that it is a universal type device that works under the drilling platform and can be located on sides or in front of the drilling platform; wherein the device can also be used with equipment from different manufacturers and can be used with equipment that is not designed from a factory.

4. A method for changing a drill bit, tricone bits or DTH bits of a surface and mining production drilling rig and for handling the guide bushings of said string on the drilling rig using the device of claim 1, comprising the steps of:

(a) opening the container (4); subsequently performing a movement of said guide bushing manipulation assembly from the inactive position to a second working position, such that the clamp or fork element (1) comes into contact with the guide bushing thereby lifting said guide bushing and disengaging it from the used bit;

(b) performing a movement of said arm unit (3) and the drill bit storage and reception element (2) from the inactive position to a second position on the drill rod; on said drilling rig the drill bit and the drill string are already in a raised position so that the drill bit storage and receiving element (2) can be exactly below said drill string and said drill bit to be changed;

(c) lowering the used bit and into the empty space and releasing the used bit from the drill string of the drill bit storage and receiving element (2), and then release the clamping of the drill bit to be changed with the torque breaking tool of the drill;

(d) the drill bit to be changed remains in the drill bit storage and receiving element unit (2); the drilling string is raised and then said storage element is moved by means of the motor units until it finds a new drill bit element that is going to be connected to the drilling string; said moving the drilling string to connect the new bit to be used on the drilling platform;

(e) lowering said clamp or fork element (1) to place said guide bushing on the new bit; and (f) moving the arm assembly (3) and bit storage and reception element (2) as well as the extension arm (5) and the clamp or fork element (1) to the inactive position inside the container element (4); then the extension arm assembly (5) and the clamp or fork element (1) are removed from the platform and taken to their rest position inside the container (4) which serves to store the entire assembly described above.

* * * * *